US009370219B1

(12) United States Patent
Little

(10) Patent No.: US 9,370,219 B1
(45) Date of Patent: Jun. 21, 2016

(54) FOOTWEAR SYSTEM

(76) Inventor: Anthony A. Little, St. Petersburg, FL (US)

( * ) Notice: Subject to any disclaimer, the term of this patent is extended or adjusted under 35 U.S.C. 154(b) by 200 days.

(21) Appl. No.: 13/341,498

(22) Filed: Dec. 30, 2011

(51) Int. Cl.
*A43B 3/10* (2006.01)
*A43B 3/12* (2006.01)
*A43C 15/16* (2006.01)

(52) U.S. Cl.
CPC ..... *A43B 3/102* (2013.01)

(58) Field of Classification Search
CPC ..... A43B 3/102; A43B 3/126; A43B 3/122; A43C 15/161; A43C 15/164; A43C 15/167
USPC ..... 36/11.5, 106, 94, 101, 35 R, 34 R, 36 B, 36/36 C, 37, 28
See application file for complete search history.

(56) References Cited

U.S. PATENT DOCUMENTS 5,438,768 A * 8/1995 Bauerfeind ..... 36/44
5,615,497 A * 4/1997 Meschan ..... 36/36 R
5,694,705 A * 12/1997 Alonso Coves ..... 36/44
5,787,609 A * 8/1998 Wu ..... 36/28
6,014,821 A * 1/2000 Yaw ..... 36/8.1
6,050,002 A * 4/2000 Meschan ..... 36/37
6,082,024 A * 7/2000 Del Biondi ..... 36/28
6,195,916 B1 * 3/2001 Meschan ..... 36/37
6,205,684 B1 * 3/2001 Snyder ..... 36/35 R
6,519,874 B1 * 2/2003 Dean ..... 36/30 R
D514,779 S * 2/2006 Birkenstock ..... D2/917
7,114,269 B2 * 10/2006 Meschan ..... 36/25 R
7,228,648 B2 * 6/2007 Yang ..... 36/35 R
7,490,416 B2 * 2/2009 Townsend ..... 36/28
7,614,167 B2 * 11/2009 Klavano ..... 36/141
7,673,398 B2 * 3/2010 Koo ..... A43C 15/161 36/134
8,117,769 B2 * 2/2012 Steele ..... 36/102
8,220,182 B2 * 7/2012 Righetto ..... 36/28
2010/0170113 A1 * 7/2010 Garza ..... 36/101

* cited by examiner

*Primary Examiner* — Robert J Hicks
*Assistant Examiner* — Timothy K Trieu

(57) ABSTRACT

A sole is formed of a body portion and an insert. The body portion has a front and a rear, interior and exterior edges, and upper and lower surfaces, the upper surface being formed with a recess having forward and rearward and intermediate regions. The recess has a circular aperture in the rearward region. The insert is formed with upper and lower surfaces and is positioned within the recess. The recess is formed with a cylindrical portion positioned in the circular aperture. Next provided is an upper adapted to hold the sole and insert to the foot of a wearer.

1 Claim, 6 Drawing Sheets

FOOTWEAR SYSTEM

BACKGROUND OF THE INVENTION

1. Field of the Invention

The present invention relates to a footwear system and more particularly pertains to maximizing support and comfort during simple walking as well as during strenuous workouts, the support and comfort being provided in a safe, convenient and economical manner.

2. Description of the Prior Art

The use of footwear of known designs and configurations is known in the prior art. More specifically, footwear of known designs and configurations previously devised and utilized for the purpose of providing comfort and support during walking and workouts are known to consist basically of familiar, expected, and obvious structural configurations, notwithstanding the myriad of designs encompassed by the crowded prior art which has been developed for the fulfillment of countless objectives and requirements.

While the prior art devices their respective, particular objectives and requirements, they do not describe a footwear system that allows for maximizing support and comfort during simple walking as well as during strenuous workouts, the support and comfort being provided in a safe, convenient and economical manner.

In this respect, the footwear system according to the present invention substantially departs from the conventional concepts and designs of the prior art, and in doing so provides an apparatus primarily developed for the purpose of maximizing support and comfort during simple walking as well as during strenuous workouts, the support and comfort being provided in a safe, convenient and economical manner.

Therefore, it can be appreciated that there exists a continuing need for a new and improved footwear system which can be used for maximizing support and comfort during simple walking as well as during strenuous workouts, the support and comfort being provided in a safe, convenient and economical manner. In this regard, the present invention substantially fulfills this need.

SUMMARY OF THE INVENTION

In view of the foregoing disadvantages inherent in the known types of footwear of known designs and configurations now present in the prior art, the present invention provides an improved footwear system. As such, the general purpose of the present invention, which will be described subsequently in greater detail, is to provide a new and improved footwear system and method which has all the advantages of the prior art and none of the disadvantages.

To attain this, the present invention essentially comprises a footwear system having a sole formed of a body portion and an insert. The body portion has a front and a rear, interior and exterior edges, and upper and lower surfaces, the upper surface being formed with a recess having forward and rearward and intermediate regions. The recess has a circular aperture in the rearward region. The insert is formed with upper and lower surfaces and is positioned within the recess. The recess is formed with a cylindrical portion positioned in the circular aperture. Next provided is an upper adapted to hold the sole and insert to the foot of a wearer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved footwear system which has all of the advantages of the prior art footwear of known designs and configurations and none of the disadvantages.

It is another object of the present invention to provide a new and improved footwear system which may be easily and efficiently manufactured and marketed.

It is further object of the present invention to provide a new and improved footwear system which is of durable and reliable constructions.

An even further object of the present invention is to provide a new and improved footwear system which is susceptible of a low cost of manufacture with regard to both materials and labor, and which accordingly is then susceptible of low prices of sale to the consuming public, thereby making such footwear system economically available to the buying public.

Even still another object of the present invention is to provide a footwear system for maximizing support and comfort during simple walking as well as during strenuous workouts, the support and comfort being provided in a safe, convenient and economical manner.

Lastly, it is an object of the present invention to provide a new and improved exercise sandal system for maximizing support and comfort during simple walking as well as during strenuous workouts, the support and comfort being provided in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
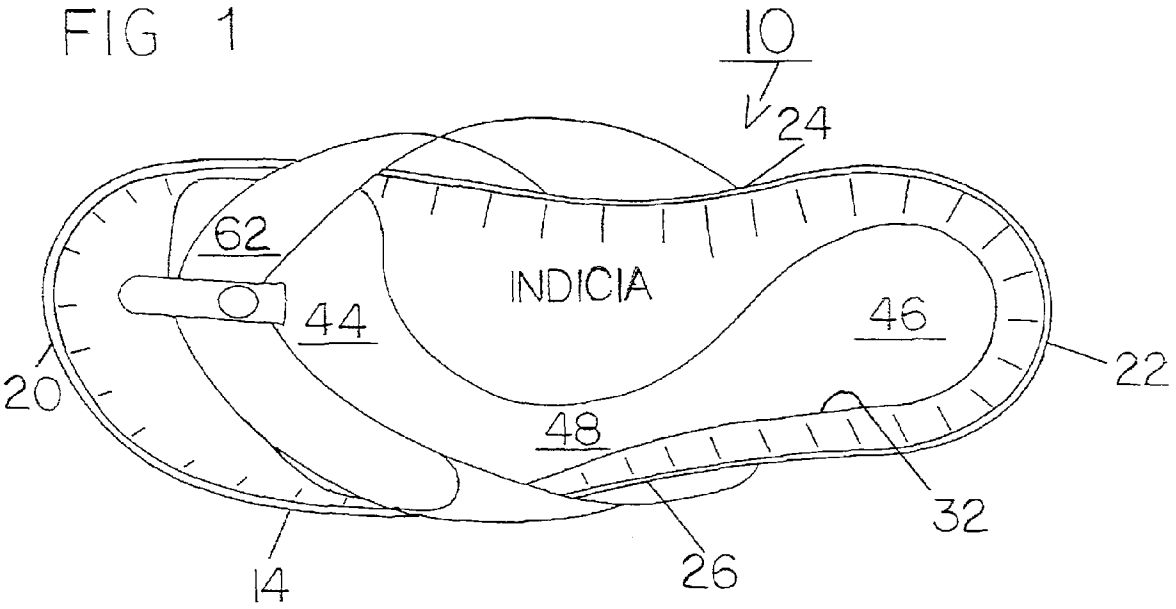
FIG. 1 is a plan view of a footwear system constructed in accordance with the principles of the present invention.
Figure 2:
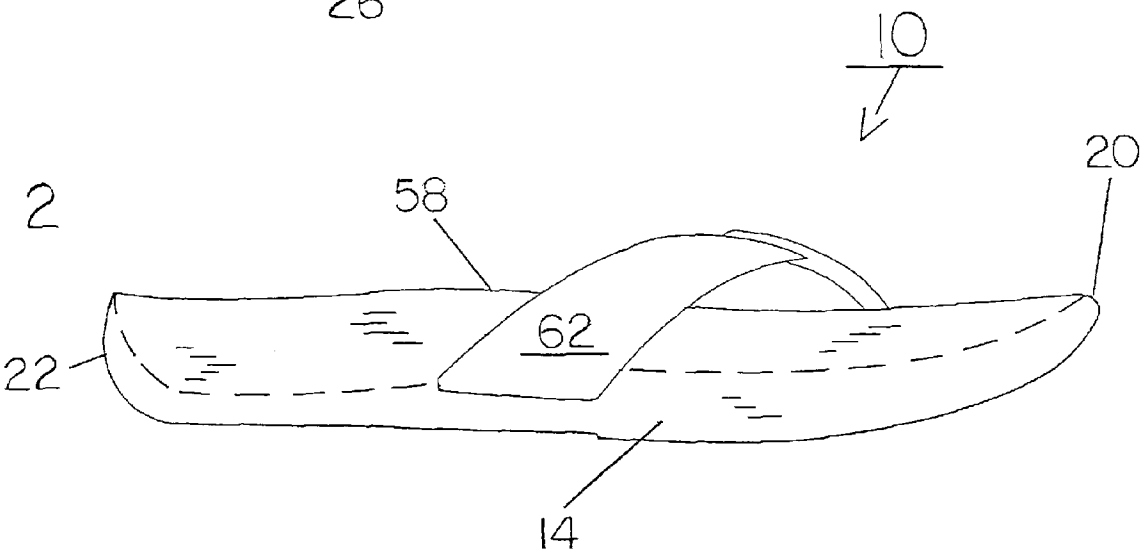
FIG. 2 is a side elevational view of the system illustrated in FIG. 1.
Figure 3:
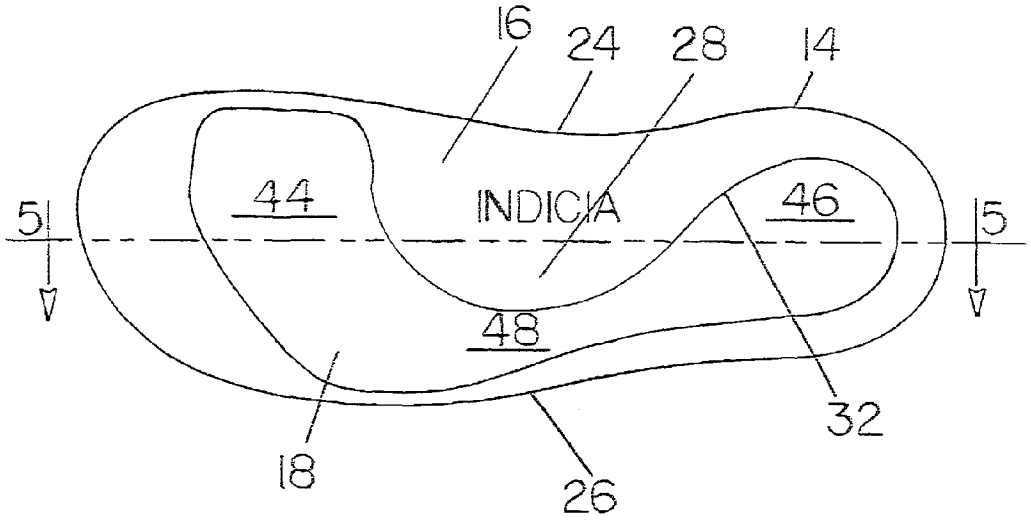
FIG. 3 is a plan view of the sole of the system illustrated in FIGS. 1 and 2.
Figure 4:
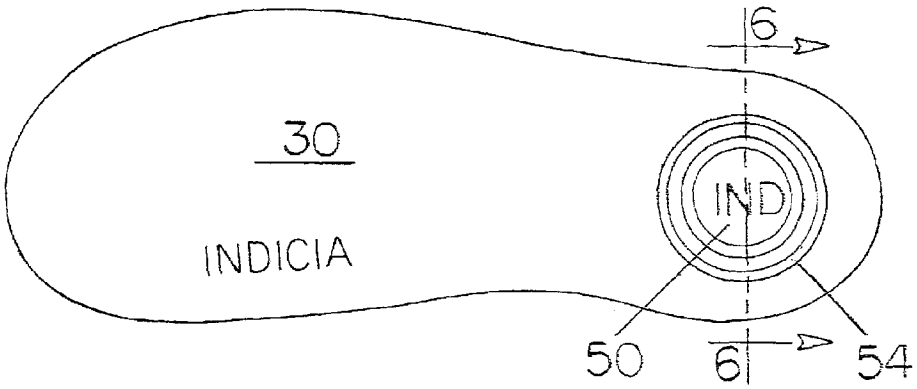
FIG. 4 is a bottom view of the sole of the system illustrated in FIGS. 1-3.
Figure 5:
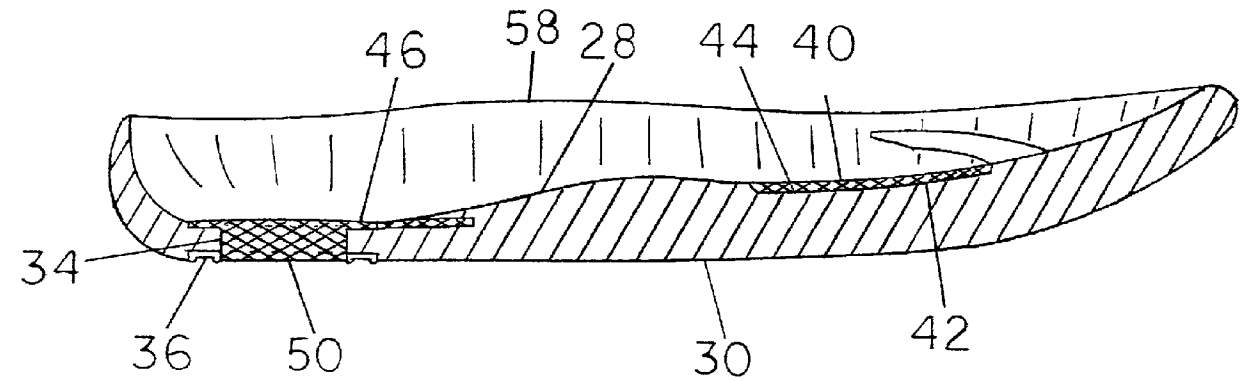
FIGS. 5 and 6 are cross sectional views taken along lines 5-5 and 6-6 of FIGS. 3 and 4.
Figure 6:
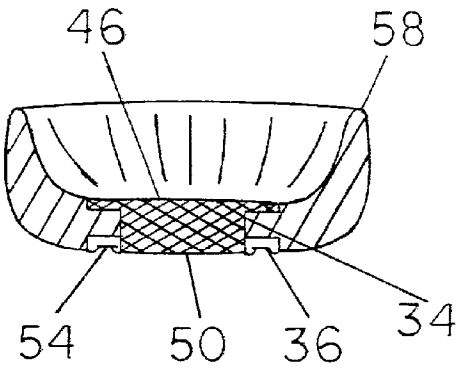
Figure 7:
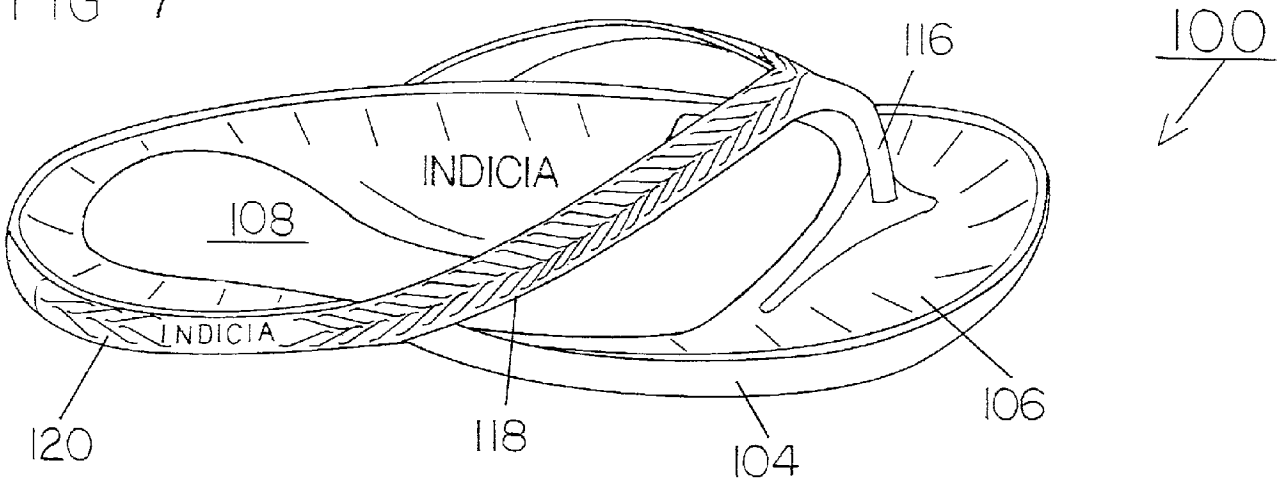
FIGS. 7 and 8 are left and right perspective views of a footwear system showing an alternate embodiment of the invention.
Figure 8:
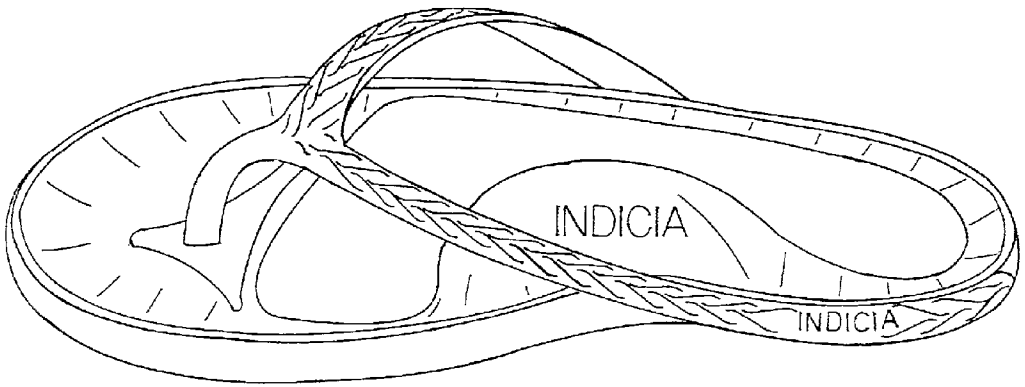
Figure 9:
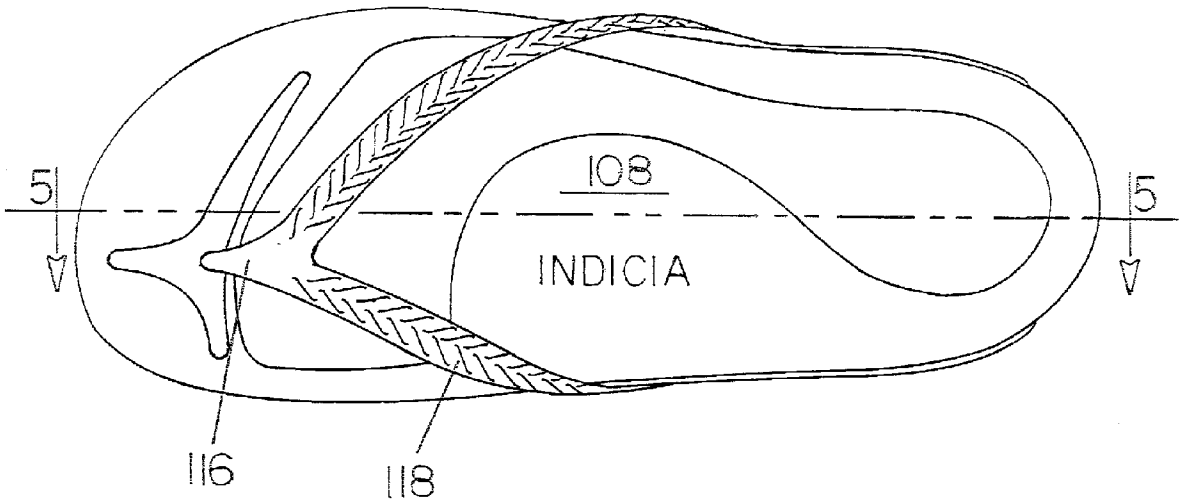
FIGS. 9 and 10 are plan and bottom views of the system of FIGS. 7 and 8.
Figure 10:
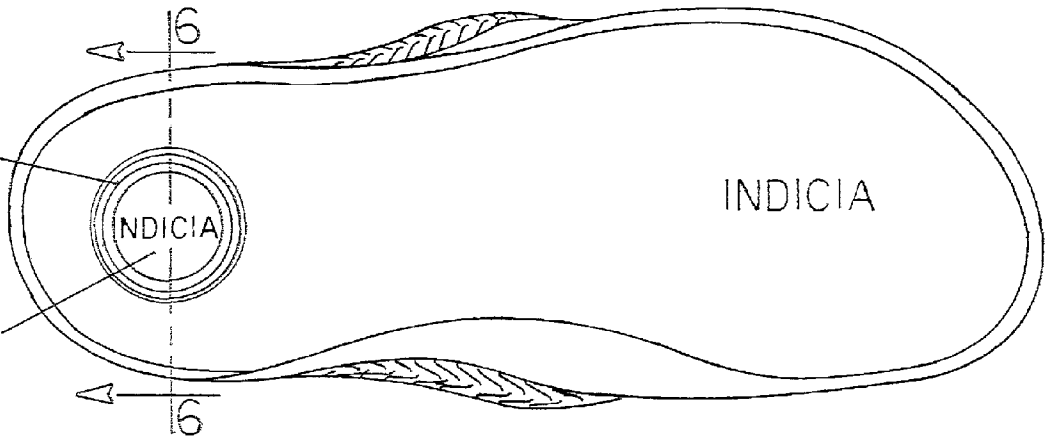
Figure 11:
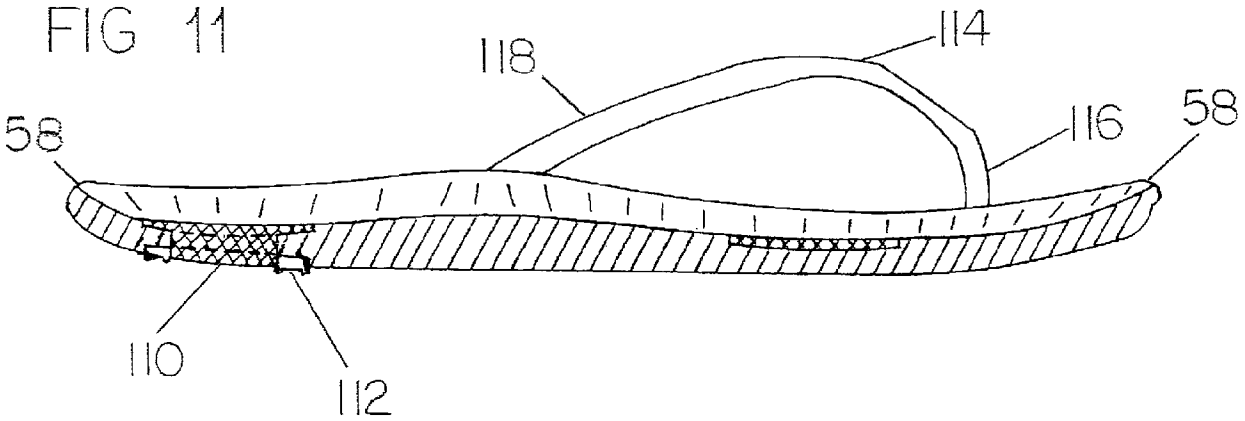
FIGS. 11 and 12 are cross sectional views taken along lines 11-11 and 12-12 of FIGS. 9 and 10.
Figure 12:
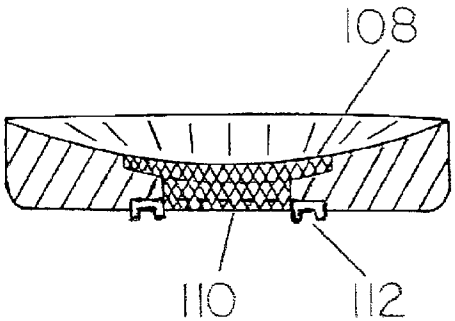

With reference now to the drawings, and in particular to FIG. 1 thereof, the preferred embodiment of the new and improved footwear system embodying the principles and concepts of the present invention and generally designated by the reference numeral 10 will be described.

The present invention, the footwear system 10 is comprised of a plurality of components. Such components in their broadest context include a body portion and an insert forming a sole and also include an upper. Such components are individually configured and correlated with respect to each other so as to attain the desired objective.

The exercise sandal system 10 of the present invention is for maximizing support and comfort during simple walking as well as during strenuous workouts. The support and comfort is provided in a safe, convenient and economical manner.

First provided is a sole 14. The sole is formed of a body portion 16 and an insert 18.

The body portion has a front 20 and a rear 22 with a length there between. The body portion also has an interior edge 24 and an exterior edge 26 with a width there between. The body portion also has an upper surface 28 and a lower surface 30 with a thickness there between. The lower surface has a tread to promote traction during walking and workouts. The lower surface is positionable in a horizontal plane from adjacent to the rear for between 60 percent and 80 percent of the length of the sole. The upper surface is formed with a recess 32. The recess has a forward region adapted to receive there above a ball of a wearer's foot. The recess has a depth and a periphery. The recess also has a rearward region adapted to receive there above a heel of the wearer's foot. The recess has an intermediate region adapted to receive there above an intermediate region of the wearer's foot laterally offset from an arch of the wearer's foot. The recess has a circular aperture 34 with a lower enlargement 36 having a length and a diameter and extending from the rearward region of the recess to and through the lower surface. The body portion is fabricated of a resilient elastomeric material. The preferred material is ethylene vinyl acetate.

The insert is formed with an upper surface 40 and a lower surface 42 with a thickness there between. The thickness of the insert is essentially equal to the depth of the recess. The insert has a periphery essentially corresponding to the periphery of the recess. The insert has a forward portion 44 extending laterally from adjacent to the interior and exterior edges and extending longitudinally for between 15 percent and 25 percent of the length of the body portion. The insert has a rearward portion 46 extending laterally from adjacent to the interior and exterior edges and extending longitudinally for between 10 percent and 20 percent of the length of the body portion. The insert has an intermediate portion 48 coupling the forward and rearward portions. The intermediate portion has a lateral width between 5 percent and 10 percent of the width of the body portion between the front and rear portions. The insert has a cylindrical portion 50 positioned in the circular aperture. The insert is fabricated of a resilient gel material. The gel material of the insert is softer and of a greater resilience than the resilient elastomeric material of the body portion.

Next provided is a ring 54 in an annular configuration functioning as a retaining ring with a length essentially equal to the length of the enlargement. The ring has an inner diameter received on the cylindrical portion. The ring has an outer diameter received in the circular aperture. The ring is fabricated of a resilient gel material. The gel material of the insert is softer and of a greater resilience than the resilient elastomeric material of the body portion.

Next, an adhesive is provided. The adhesive couples the insert to the body portion and couples the ring to the body portion and the insert.

Indicia is next provided. The indicia is located on the body portion of the sole and on the insert.

The upper surface of the insert is essentially co-extensive with the upper surface of the body portion. The upper surfaces of the body portion and the insert adjacent to the front are at a higher elevation than the upper surfaces of the body portion and the insert adjacent to the rear to provide a reverse incline of between 2 and 4 degrees.

The body portion has a periphery 58 extending upwardly from the upper surfaces of the body portion and the insert. In this manner, the foot of the wearer is received within the sole and not on the sole.

Lastly, the system has an upper 62. The upper is coupled to the sole for holding the sole on the foot of the wearer during walking and workouts.

An alternate embodiment of the footwear system 100 of the present invention is illustrated in FIGS. 7 through 12. On this embodiment, the footwear system is a thong. The sole 104 including the body portion 106 is fabricated of an elastomeric material. The insert 108 including the cylinder 110 is fabricated of a gel material. The upper includes an upwardly projecting finger 116 and rearwardly extending straps with forward sections 118 coupled to the finger and rearward sections 120 coupled to the body portion adjacent to the rear. The forward section has a forwardly facing herringbone configuration. The rearward section has a rearwardly facing herringbone configuration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise sandal system (10) for maximizing support and comfort during simple walking as well as during strenuous workouts, the sandal system comprising, in combination:

a sole (14) formed of a body portion (16) and an insert (18), the body portion having a front (20) and a rear (22) with a sole length there between, the body portion having an interior edge (24) and an exterior edge (26) with a width there between, the body portion having an upper surface (28) and a lower surface (30) with a thickness there between, the lower surface having a tread to promote traction during walking and workouts, the lower surface positionable in a horizontal plane, the horizontal plane extending from adjacent to the rear between 60 percent to 80 percent, as compared to the sole length, the upper surface formed with a recess (32), the recess having a forward region adapted to receive there above a ball of a wearer's foot, the recess having a depth and a periphery, the recess having a rearward region adapted to receive there above a heel of the wearer's foot, the recess having an intermediate region adapted to receive there above an intermediate region of the -wearer's foot laterally off set from an arch of the wearer's foot, the recess having a circular aperture (34) with a lower enlargement (36) having a length and a diameter and extending from the rearward region of the recess to and through the lower surface, the body portion being fabricated of a resilient elastomeric material; the insert formed with an upper surface (40) and a lower surface (42) with a thickness there between, the thickness of the insert being essentially equal to the depth of the recess, the insert having a periphery essentially corresponding to the periphery of the recess, the insert having a forward portion (44) extending laterally from adjacent to the interior and exterior edges and extending longitudinally for between 15 percent and 25 percent of the length of the body portion, the insert having a rearward portion (46) extending laterally from adjacent to the interior and exterior edges and extending longitudinally for between 10 percent and 20 percent of the length of the body portion, the insert having an intermediate portion (48) coupling the forward and rearward portions, the intermediate portion having a lateral width between 5 percent and 10 percent of the width of the body portion between the front and rear portions, the insert having a cylindrical portion (50) positioned in the circular aperture, the insert being fabricated of a resilient gel material, the gel material of the insert being softer and of a greater resilience than the resilient elastomeric material of the body portion;

a ring (54) in an annular configuration functioning as a retainer ring with a length essentially equal to the length of the enlargement, the ring having an inner diameter received on the cylindrical portion, the ring having an outer diameter received in the circular aperture, the ring being fabricated of a resilient gel material, the gel material of the insert being softer and of a greater resilience than the resilient elastomeric material of the body portion; an adhesive coupling the insert to the body portion and coupling the ring to the body portion and the insert; indicia located on the body portion of the sole and on the insert; the upper surface of the insert being essentially co-extensive with the upper surface of the body portion, the upper surfaces of the body portion and the insert adjacent to the front being at a higher elevation than the upper surfaces of the body portion and the insert adjacent to the rear to provide a reverse incline of between 2 and 4 degrees; the body portion having a periphery (58) extending upwardly from the upper surfaces of the body portion and the insert whereby the foot of the wearer is received within the periphery of the body portion; and the system having an upper (62) coupled to the sole for holding the sole on the foot of the wearer during walking and workouts.

* * * * *